US010214313B2

(12) United States Patent
Oshino et al.

(10) Patent No.: US 10,214,313 B2
(45) Date of Patent: Feb. 26, 2019

(54) BOTTLE

(71) Applicants: Tadayoshi Oshino, Matsudo (JP); Hiromichi Saito, Tokyo (JP); Hirohisa Yamazaki, Matsudo (JP); Takuya Nishimura, Omihachiman (JP)

(72) Inventors: Tadayoshi Oshino, Matsudo (JP); Hiromichi Saito, Tokyo (JP); Hirohisa Yamazaki, Matsudo (JP); Takuya Nishimura, Omihachiman (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 14/371,040

(22) PCT Filed: Dec. 20, 2012

(86) PCT No.: PCT/JP2012/083135
§ 371 (c)(1),
(2) Date: Jul. 8, 2014

(87) PCT Pub. No.: WO2013/114760
PCT Pub. Date: Aug. 8, 2013

(65) Prior Publication Data

US 2015/0008210 A1 Jan. 8, 2015

(30) Foreign Application Priority Data

Jan. 30, 2012 (JP) ..... 2012-016775

(51) Int. Cl.
*B65D 1/00* (2006.01)
*B65D 1/02* (2006.01)
*B65D 1/44* (2006.01)

(52) U.S. Cl.
CPC ..... *B65D 1/0276* (2013.01); *B65D 1/0223* (2013.01); *B65D 1/0261* (2013.01);
(Continued)

(58) Field of Classification Search
CPC ..... B65D 1/00; B65D 1/06; B65D 1/0261; B65D 2501/0027; B29C 49/4815; B29C 49/54; B29C 49/541; B29C 2049/4892
(Continued)

(56) References Cited

U.S. PATENT DOCUMENTS 5,385,250 A * 1/1995 Pasquale ..... 215/374
D398,855 S * 9/1998 Ito ..... D9/537
(Continued)

FOREIGN PATENT DOCUMENTS

JP 328125-001 4/1969
JP 813079 5/1991
(Continued)

OTHER PUBLICATIONS

International Search Report issued in International Patent Application No. PCT/JP2012/083135 dated Apr. 2, 2013 (with translation).
(Continued)

*Primary Examiner* — Ernesto Grano
(74) *Attorney, Agent, or Firm* — Oliff PLC

(57) ABSTRACT

The present invention is a bottle that is formed from a synthetic resin material in a cylindrical shape having a bottom at one end, including: a plurality of circumferential grooves that extend continuously around the entire circumference of a body portion and are formed at a distance from each other in a vertical direction. The circumferential grooves extend cyclically in a circumferential direction while undulating in the vertical direction when viewed from the side of the body portion as to form wave patterns, and the respective phases of circumferential grooves that are mutually adjacent to each other in the vertical direction are offset from each other.

6 Claims, 8 Drawing Sheets

(52) U.S. Cl.
CPC ..... *B65D 1/44* (2013.01); *B65D 2501/0027* (2013.01); *B65D 2501/0036* (2013.01)

(58) Field of Classification Search
USPC ..... 215/375, 382, 376, 371
See application file for complete search history.

(56) References Cited

U.S. PATENT DOCUMENTS

| | | | | | |
|---|---|---|---|---|---|
| D404,311 | S | * | 1/1999 | Zimmer et al. | D9/552 |
| 5,988,417 | A | * | 11/1999 | Cheng et al. | 215/383 |
| D465,158 | S | * | 11/2002 | Peek et al. | D9/538 |
| D466,023 | S | * | 11/2002 | Eickmeier | D9/552 |
| D503,341 | S | * | 3/2005 | Delmotte | D9/538 |
| D506,139 | S | * | 6/2005 | Zboch et al. | D9/539 |
| D506,142 | S | * | 6/2005 | Gauthier | D9/560 |
| D510,027 | S | * | 9/2005 | Zboch et al. | D9/516 |
| D517,864 | S | * | 3/2006 | Yu | D7/510 |
| D527,267 | S | * | 8/2006 | Zboch | B65D 1/0261 D9/516 |
| D546,700 | S | * | 7/2007 | Bourne | D9/552 |
| D561,597 | S | * | 2/2008 | Venkataraman et al. | D9/550 |
| D584,628 | S | * | 1/2009 | Lepoitevin | D9/538 |
| D596,040 | S | * | 7/2009 | Lepoitevin | D9/552 |
| D602,783 | S | * | 10/2009 | Lepoitevin | D9/538 |
| 7,694,842 | B2 | * | 4/2010 | Melrose | 220/666 |
| D630,515 | S | * | 1/2011 | Bretz et al. | D9/520 |
| D647,804 | S | * | 11/2011 | Yourist et al. | D9/538 |
| D658,065 | S | * | 4/2012 | Oommen | B65D 1/0261 D9/520 |
| 8,162,162 | B2 | * | 4/2012 | Hata et al. | 215/382 |
| 8,276,774 | B2 | * | 10/2012 | Patcheak et al. | 215/373 |
| 8,286,814 | B2 | * | 10/2012 | Pritchett, Jr. | 215/381 |
| D671,007 | S | * | 11/2012 | Lovelace et al. | D9/516 |
| D700,520 | S | * | 3/2014 | Haner | B65D 1/0261 D9/516 |
| 2003/0010743 | A1 | | 1/2003 | Boukobza | |
| 2007/0012649 | A1 | | 1/2007 | Kamineni et al. | |
| 2008/0093329 | A1 | * | 4/2008 | Mooney | 215/379 |
| 2011/0017700 | A1 | * | 1/2011 | Patcheak et al. | 215/381 |
| 2011/0233166 | A1 | | 9/2011 | Hiromichi et al. | |
| 2013/0140264 | A1 | * | 6/2013 | Hanan | 215/384 |
| 2013/0213926 | A1 | * | 8/2013 | Kurihara et al. | 215/371 |
| 2014/0183202 | A1 | * | 7/2014 | Hanan | 220/669 |

FOREIGN PATENT DOCUMENTS

| | | | |
|---|---|---|---|
| JP | 107172424 | A | 7/1995 |
| JP | H09-240647 | A | 9/1997 |
| JP | 109272523 | A | 10/1997 |
| JP | A-10-29614 | | 2/1998 |
| JP | 1038046 | | 5/1999 |
| JP | 3058345 | U | 6/1999 |
| JP | 2000-127231 | A | 5/2000 |
| JP | 2001-039423 | A | 2/2001 |
| JP | A-2003-522681 | | 7/2003 |
| JP | 1187669 | | 8/2003 |
| JP | 1188120 | | 8/2003 |
| JP | B2-3515848 | | 4/2004 |
| JP | A-2006-16076 | | 1/2006 |
| JP | A-2006-528116 | | 12/2006 |
| JP | A-2007-253997 | | 10/2007 |
| JP | A-2007-269392 | | 10/2007 |
| JP | A-2008-539141 | | 11/2008 |
| JP | 2012-076747 | A | 4/2012 |
| JP | 2012-513351 | A | 6/2012 |
| JP | 2012-126448 | A | 7/2012 |
| JP | 2015-500188 | A | 1/2015 |
| WO | WO 2004/106175 | A1 | 12/2004 |
| WO | WO 2006/118584 | A1 | 11/2006 |
| WO | 2010/075001 | A2 | 7/2010 |
| WO | 2013-085919 | A1 | 6/2013 |

OTHER PUBLICATIONS

Sep. 23, 2015 Search Report issued in European Patent Application No. 12867706.9.
Nov. 24, 2015 Office Action issued in Japanese Patent Application No. 2012-016775.
Dec. 8, 2015 Office Action issued in Japanese Patent Application No. 2012-016775.
Jul. 26, 2016 Office Action issued in Japanese Patent Application No. 2012-016775.
Apr. 30, 2015 Office Action issued in Chinese Patent Application No. 201280067797.6.
Jun. 2, 2015 Japanese Office Action issued in Japanese Patent Application No. 2012-016775.
Mar. 13, 2018 Office Action issued in Japanese Patent Application No. 2012-016775.

* cited by examiner

BOTTLE

TECHNICAL FIELD

The present invention relates to a bottle. Priority is claimed on Japanese Patent Application No. 2012-016775, filed Jan. 30, 2012, the contents of which are incorporated herein by reference.

TECHNICAL BACKGROUND

Conventionally, a bottle in which the rigidity of the body portion in the bottle radial direction is increased by forming a plurality of circumferential grooves that extend continuously around the entire circumference of the body portion at intervals from each other in a vertical direction is known as a bottle that is formed from a synthetic resin material in a cylindrical shape having a bottom at one end. As a bottle of this type, in recent years, a bottle such as that shown, for example, in Patent document 1 has been proposed in which a plurality of circumferential groves extend cyclically in a circumferential direction while undulating up and down in a vertical direction when viewed from the side of the body portion so as to form wave patterns having the same shape and size as each other.

DOCUMENTS OF THE PRIOR ART

Patent Documents

[Patent document 1] Japanese Patent No. 3515848

DISCLOSURE OF THE INVENTION

Problems to be Solved by the Invention

However, in the above-described conventional bottle, there is a possibility that the buckling strength of the bottle will be reduced as a result of the circumferential grooves being formed.

The present invention was conceived in view of the above-described circumstances, and it is an object thereof to provide a bottle in which it is possible to curb any decrease in buckling strength that is caused by circumferential grooves being formed.

Means for Solving the Problem

The present invention employs the following structure as a means of solving the aforementioned problem. A first aspect of the present invention is a bottle that is formed from a synthetic resin material in a cylindrical shape having a bottom at one end, wherein the bottle is provided with a plurality of circumferential grooves that extend continuously around the entire circumference of a body portion and are formed at a distance from each other in a vertical direction. These circumferential grooves extend cyclically in a circumferential direction while undulating up and down in a vertical direction when viewed from the side of the body portion so as to form wave patterns, and the respective phases of circumferential grooves that are mutually adjacent to each other in the vertical direction are offset from each other.

According to a first aspect of the present invention, because a plurality of circumferential grooves are formed on the body portion, it is possible to increase the rigidity of the body portion in the bottle radial direction. Moreover, the circumferential grooves form a wave pattern when viewed from the side of the body portion, and the respective phases of circumferential grooves that are mutually adjacent to each other in the vertical direction are offset from each other. Because of this, when axial force is applied in a compression direction to the bottle, it is possible to suppress any compression deformation of the body portion that might cause the groove width of the circumferential grooves to become narrower around the entire circumference. Namely, it is possible to curb any decrease in the buckling strength of the bottle that arises as a result of the circumferential grooves being formed.

In a second aspect of the present invention, in the bottle according to the above-described first aspect, the circumferential grooves are formed having the same shape and size as each other. According to this second aspect, the above-described operational effects are reliably achieved.

In a third aspect of the present invention, in the bottle according to the above-described first and second aspects, the positions of each tip (hill portion upper tip and valley portion lower tip) portion of circumferential grooves that are mutually adjacent to each other in a vertical direction are offset from each other in the circumferential direction.

According to this third aspect, the positions of each tip portion of circumferential grooves that are mutually adjacent to each other in a vertical direction are offset from each other in the circumferential direction. Because of this, it is possible to prevent any portions whose size in a vertical direction is excessively narrow from being created in a portion of the body portion that is positioned between circumferential grooves that are mutually adjacent to each other in the vertical direction, and it is possible to make it difficult for areas where stress is concentrated to occur in the body portion.

In a fourth aspect of the present invention, in the bottle according to any one of the above-described first through third aspects, a bottom wall portion of the bottom portion is provided with a grounding portion that is positioned at an outer circumferential edge thereof, a rising circumferential wall portion that continues on from an inner side in the bottle radial direction to the grounding portion and extends upwards, an annular movable wall portion that protrudes from an upper end of the rising circumferential wall portion towards the inner side in the bottle radial direction, and a recessed circumferential wall portion that extends upwards from an inner end in the bottle radial direction of the movable wall portion. This movable wall portion is provided such that it is able to pivot freely around a connected portion with the rising circumferential wall portion so as to cause the recessed circumferential wall portion to move in a vertical direction.

According to this fourth aspect, the movable wall portion is provided such that it is able to pivot freely around the connected portion with the rising circumferential wall portion so as to cause the recessed circumferential wall portion to move in a vertical direction. Because of this, by causing the movable portion to pivot whenever there is any variation in the bottle internal pressure, this internal pressure variation can be absorbed.

Effects of the Invention

According to the present invention, it is possible to provide a bottle in which it is possible to curb any decrease in the buckling strength of the bottle that arises as a result of circumferential grooves being formed.

BEST EMBODIMENTS FOR IMPLEMENTING THE INVENTION (First Embodiment)

Figure 1:
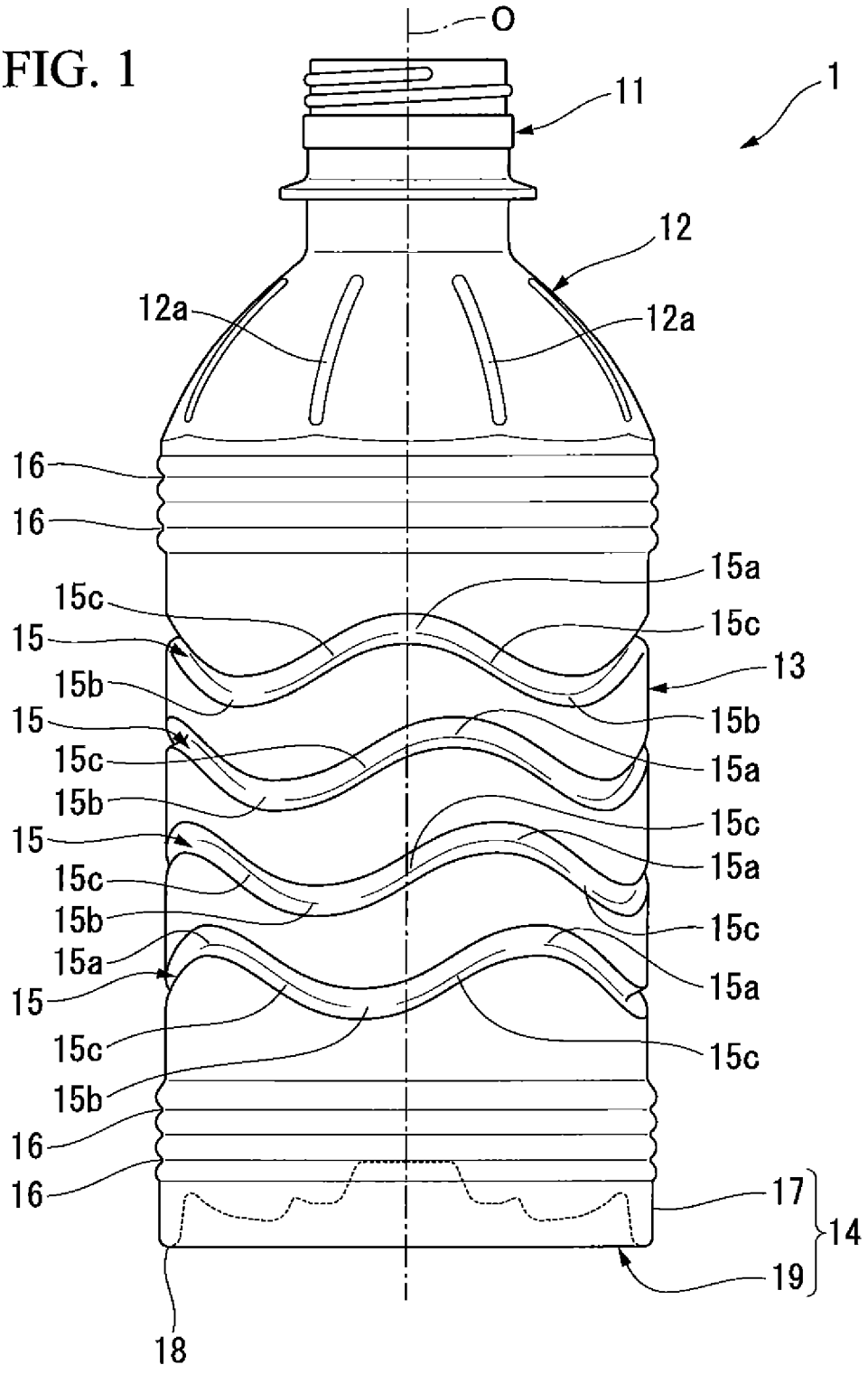
FIG. 1 is a side view of a bottle that is shown as a first embodiment of the present invention.

Hereinafter, a bottle according to a first embodiment of the present invention will be described with reference made to the drawings. As is shown in FIG. 1, a bottle 1 according to the first embodiment is provided with a mouth portion 11, a shoulder portion 12, a body portion 13, and a bottom portion 14, and these portions are provided in the above sequence such that the center axis of each one is positioned on a common axis.

Hereinafter, this common axis is referred to as the bottle axis O, and the mouth portion 11 side in the direction of the bottle axis O is referred to as the top side, while the bottom portion 14 side is referred to as the bottom side. Moreover, an orthogonal direction relative to the bottle axis O is referred to as the bottle radial direction, while a direction orbiting around the bottle axis O is referred to as the circumferential direction. Note that the bottle 1 is formed as a single unit from a synthetic resin material. Moreover, a cap (not shown) is screwed onto the mouth portion 11. Furthermore, the mouth portion 11, the shoulder portion 12, the body portion 13, and the bottom portion 14 each have a circular shape when viewed on a horizontal cross-section that is orthogonal to the bottle axis O.

A plurality of vertical grooves 12*a* are formed extending in the direction of the bottle axis O along an outer circumferential surface of the shoulder portion 12 at a distance from each other in the circumferential direction. The body portion 13 is formed in a cylindrical shape, and an intermediate portion between the two end portions thereof in the direction of the bottle axis O is formed having a smaller diameter compared to these two end portions. A plurality of narrow grooves 16 are formed at a distance from each other in the direction of the bottle axis O such that they extend continuously around the entire circumference of each of the two ends in the direction of the bottle axis O of the body portion 13.

A plurality of circumferential grooves 15 are formed at a distance from each other in the direction of the bottle axis O such that they extend continuously around the entire circumference of the body portion 13. In the example shown in the drawings, the groove width of the circumferential grooves 15 is wider than the groove width of the narrow grooves 16. The plurality of circumferential grooves 15 are arranged across the entire range in the direction of the bottle axis O of the aforementioned intermediate portion of the body portion 13 at a distance from each other in the direction of the bottle axis O. Each of the circumferential grooves 15 forms a wave pattern having the same shape and size as the other wave patterns that extend cyclically in the circumferential direction while undulating in the direction of the bottle axis O when viewed from the side of the body portion 13. In the example shown in the drawings, each of the circumferential grooves 15 completes one circuit around the body portion 13 in a four-stage cycle. Namely, the circumferential grooves 15 are formed such that a 90° angular range centered on the bottle axis O forms one stage of the cycle. Furthermore, circumferential grooves 15 that are mutually adjacent to each other in the direction of the bottle axis O remain apart from each other in the direction of the bottle axis O around the entire circumference. Namely, circumferential grooves 15 that are mutually adjacent to each other in the direction of the bottle axis O are arranged on the body portion 13 such that an area in the direction of the bottle axis O where one circumferential groove 15 is located does not overlap with an area in the direction of the bottle axis O where another circumferential groove 15 is located.

In the first embodiment, the respective phases of circumferential grooves 15 that are mutually adjacent to each other in the direction of the bottle axis O are offset from each other. Furthermore, in the first embodiment, positions of respective upper tip portions 15*a* and lower tip portions 15*b* of circumferential grooves 15 that are mutually adjacent to each other in the direction of the bottle axis O are mutually offset from each other in the circumferential direction. As a consequence of this, of the circumferential grooves 15 that are mutually adjacent to each other in the direction of the bottle axis O, the tip portions 15*a* and 15*b* of one circumferential groove 15 are located in an area in the circumferential direction where an intermediate portion 15*c* that is located between adjacent tip portions 15*a* and 15*b* of the other circumferential groove 15 is positioned. Note that in the example shown in the drawings, a portion 15*a* forming an upwardly protruding curve (hereinafter, referred to as an upper tip portion) and a portion 15*b* forming a downwardly protruding curve (hereinafter, referred to as a lower tip portion) when the body portion 13 is viewed from the side serve as the tip portions 15*a* and 15*b*.

Figure 2:
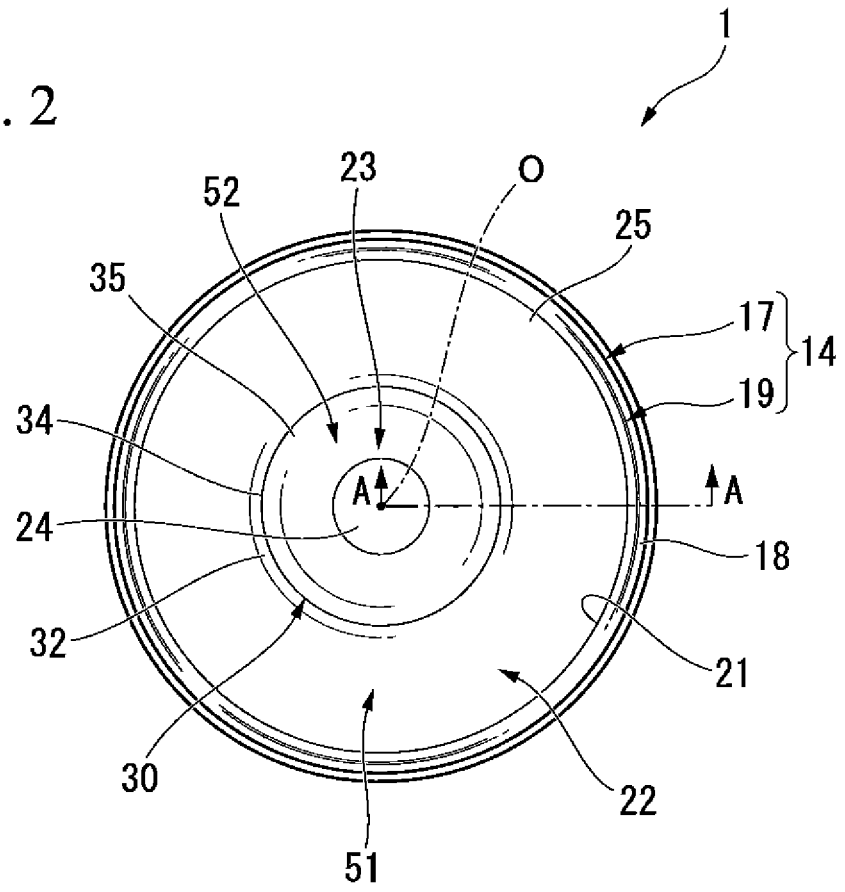
FIG. 2 is a bottom view of the bottle shown in FIG. 1.
Figure 3:
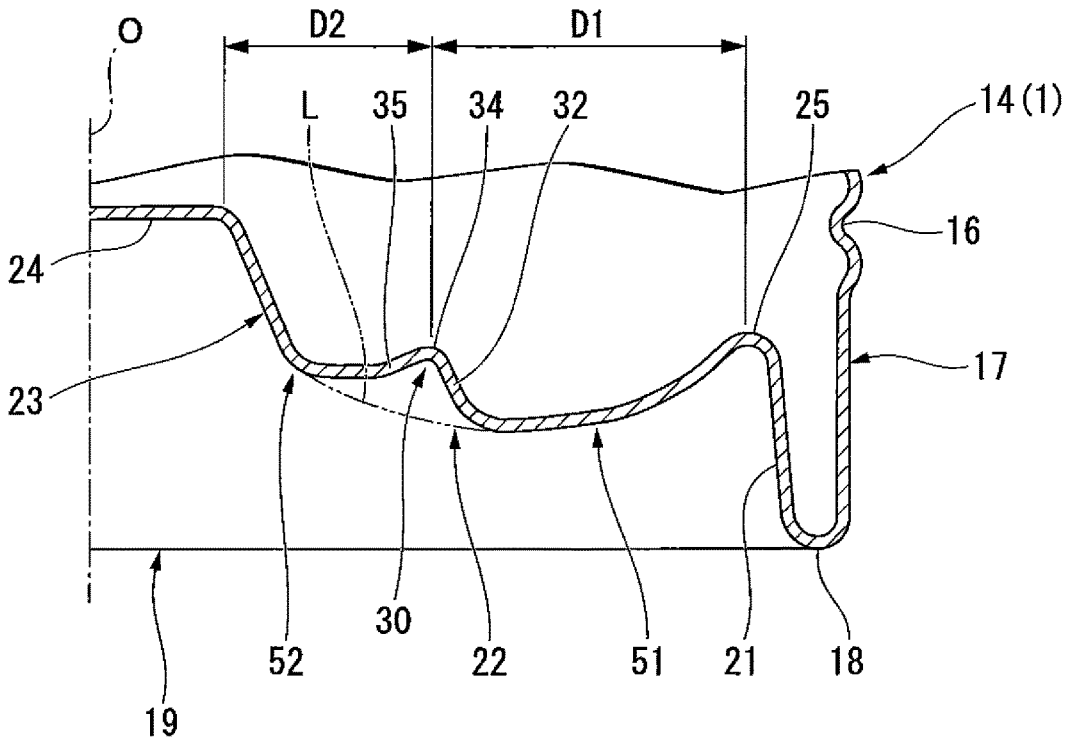
FIG. 3 is a cross-sectional view taken along a line A-A of the bottle shown in FIG. 2.

The bottom portion 14 is formed in a cup shape, and is provided with a heel portion 17 and whose upper opening section is connected to a lower opening section of the body portion 13, and a bottom wall portion 19 that seals off the lower opening section of the heel portion 17 and whose outer circumferential edge portion forms a grounding portion 18. As is shown in FIG. 2 and FIG. 3, the bottom wall portion 19 is provided with a rising circumferential wall portion 21 that continues on from an inner side in the bottle radial direction to the grounding portion 18 and extends upwards, an annular movable wall portion 22 that protrudes from an upper end of the rising circumferential wall portion 21 towards the inner side in the bottle radial direction, and a recessed circumferential wall portion 23 that extends upwards from an inner end in the bottle radial direction of the movable wall portion 22. The movable wall portion 22 is provided such that it is able to pivot freely around a curved surface part (described below) 25 (i.e., a connected portion that connects to the rising circumferential wall portion 21) so as to cause the recessed circumferential wall portion 23 to move in the direction of the bottle axis O.

The movable wall portion 22 is provided coaxially with the bottle axis O, and is formed as a curved surface that protrudes downwards. This movable wall portion 22 and the rising circumferential wall portion 21 are joined together via the curved surface part 25 that protrudes upwards. The recessed circumferential wall portion 23 is provided coaxially with the bottle axis O, and continues on from an inner end in the bottle radial direction of the movable wall portion 22, and also gradually narrows in diameter as it moves in an upward direction. In addition, the recessed circumferential wall portion 23 is formed as a capped cylinder, and is provided with an apex wall 24 that is orthogonal to the bottle axis O.

An annular concave portion 30 that is hollowed out in an upward direction is provided extending continuously around the entire circumference of the movable wall portion 22. The annular concave portion 30 is placed in a position of the movable wall portion 22 that is offset towards the inner side in the bottle radial direction from the center of the movable wall portion 22 in the bottle radial direction. The annular concave portion 30 is surrounded by a protruding end part 34 that is formed as an upwardly protruding curved surface, an outside curved wall 32 that continues on from an outer side in the bottle radial direction of the protruding end part 34, and an inside curved wall 35 that continues on from an inner side in the bottle radial direction of the protruding end part 34.

The outside curved wall 32 extends gradually downwards as it moves from an inner side to an outer side in the bottle radial direction, and is formed as a downwardly-protruding curved surface. An upper end of the outside curved wall 32 is continuous with an outer end portion in the bottle radial direction of the protruding end part 34. The inside curved wall 35 extends gradually upwards as it moves from an inner side to an outer side in the bottle radial direction, and is formed as a downwardly protruding curved surface. An upper end of the inside curved wall 35 is continuous with an inner end portion in the bottle radial direction of the protruding end part 34. The annular concave portion 34 is formed such that its size in the bottle radial direction becomes gradually smaller as it moves upwards.

Note that in the first embodiment, the radius of curvatures of each of the movable wall portion 22, the curved surface part 25, and the protruding end part 34 are smaller in the above sequence. The protruding end part 34 of the annular concave portion 30 is positioned lower than an upper end of the curved surface part 25. In the annular concave portion 30, the entire protruding end part 34, outside curved wall 32, and inside curved wall 35 are positioned above a virtual line L that extends so as to follow the surface profiles of the outer end in the bottle radial direction of the outside curved wall 32 and the inner end in the bottle radial direction of the inside curved wall 35 (i.e., the portion thereof that is connected to the recessed circumferential wall portion 23). Furthermore, a distance Dl that extends in the bottle radial direction between the curved surface part 25 and the protruding end part 34 is longer than a distance D2 that extends in the bottle radial direction between the protruding end part 34 and an outer circumferential edge of the apex wall 24 of the recessed circumferential wall portion 23.

In addition, a portion of the movable wall portion 22 that is positioned on the outer side in the bottle radial direction of the protruding end part 34, specifically, a portion of the movable wall portion 22 that is positioned on the outer side in the bottle radial direction of the outside curved wall 32 (hereinafter, referred to as an outside wall portion 51) is formed more thinly than the recessed circumferential wall portion 23 and the inside curved wall 35 of the movable wall portion 22 (hereinafter, these latter portions are referred to collectively as an inside wall portion 52).

The above-described bottle 1 is formed by biaxial stretch blow molding. Namely, firstly, a cylindrical preform having a bottom at one end thereof is formed from a synthetic resin material by injection molding. Next, this preform is set inside a cavity, and air is blown into the preform. As a result of this, the preform is inflated while being stretched in both the direction of the bottle axis O and the bottle radial direction. As a consequence, the cylindrical bottle 1 having a bottom at one end thereof is formed so as to match the contour of the internal surface of the cavity.

Figure 4:
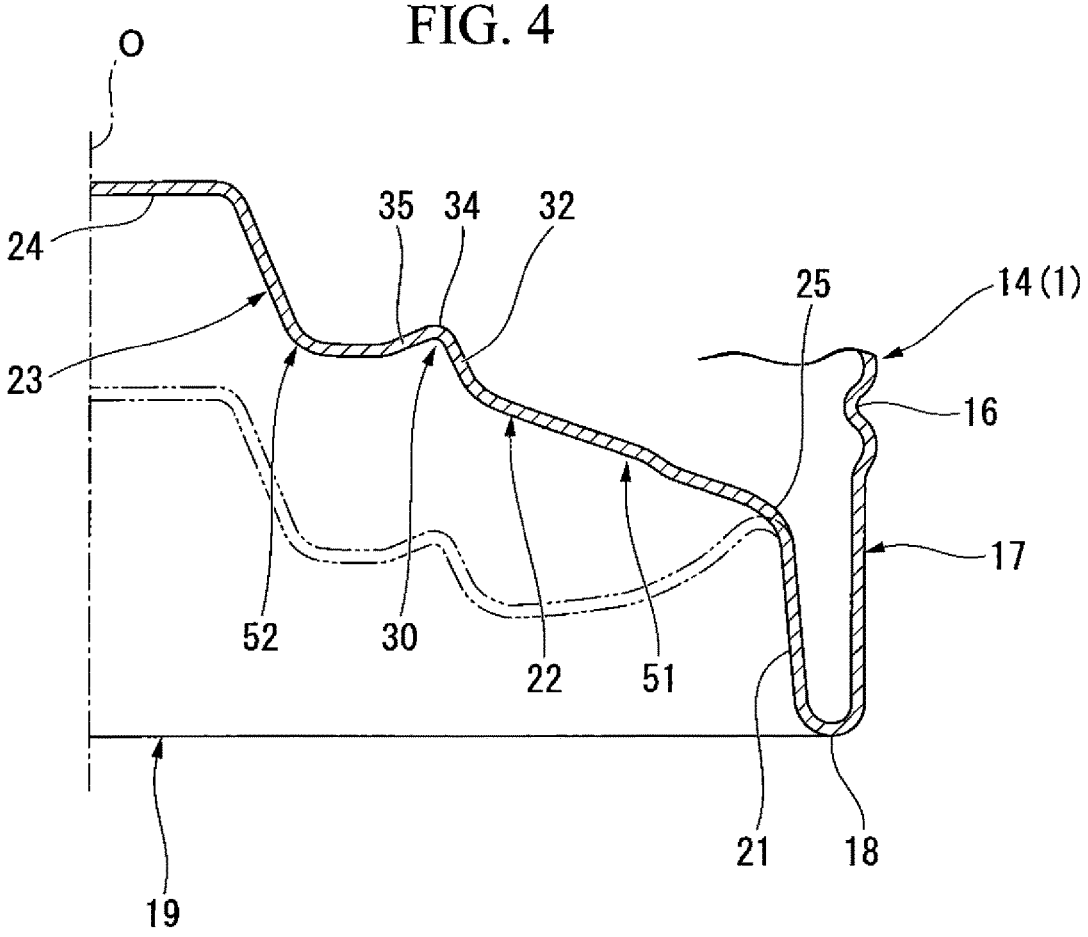
FIG. 4 is a schematic view showing the bottle shown in FIG. 3 in a decreased pressure state.

During the process to form the preform by means of biaxial stretch blow molding, when the synthetic resin material reaches the portion of the cavity internal surface that forms the protruding end part 34 of the annular concave portion 30, the momentum of the flow of synthetic resin material is weakened. As a consequence of this, the synthetic resin material forming the outside wall portion 51 is stretched more than the synthetic resin material forming the inside wall portion 52. As a result, the outside wall portion 51 is formed more thinly than the inside wall portion 52. Because of this, when there is a variation in the internal pressure inside the bottle 1, as is shown, for example, in FIG. 4, the curved surface of the outside wall portion 51 that bulges downwards is easily deformed into a flat shape, so that the internal pressure variation is effectively absorbed.

Moreover, the inside curved wall 35 extends gradually upwards as it moves from the inner side towards the outer side in the bottle radial direction. Because of this, as is described above, during the biaxial stretch molding process, when the synthetic resin material reaches the portion of the cavity internal surface that forms the protruding end part 34 of the annular concave portion 30, the momentum of the flow of synthetic resin material is effectively weakened. Furthermore, the outside curved wall 32 extends gradually downwards as it moves from the inner side towards the outer side in the bottle radial direction. Because of this, as is described above, during the biaxial stretch molding process, the synthetic resin material that travels past the portion of the cavity internal surface that forms the protruding end part 34 of the annular concave portion 30 flows smoothly towards the outer side in the bottle radial direction while meeting only minimal resistance.

As is described above, according to the bottle 1 of the first embodiment, a plurality of circumferential grooves 15 are formed in the body portion 13. Because of this, it is possible to increase the rigidity in the bottle radial direction of the body portion 13. Moreover, according to the bottle 1 of the first embodiment, the circumferential grooves 15 form a wave pattern when viewed from the side of the body portion 13, and the respective phases of circumferential grooves 15 that are mutually adjacent to each other in the direction of the bottle axis O are mutually offset from each other. As a consequence, when axial force is applied in a compression direction to the bottle 1, it is possible to suppress any compression deformation of the body portion 13 that might cause the groove width of the circumferential grooves 15 to become narrower around the entire circumference. Thereby, it is possible to curb any decrease in the buckling strength that may occur as a result of the circumferential grooves 15 being formed. Furthermore, because the positions of the respective tip portions 15*a* and 15*b* of circumferential grooves 15 that are mutually adjacent to each other in the direction of the bottle axis O are offset from each other in the circumferential direction, it is possible to prevent any portions whose size in the direction of the bottle axis O is excessively narrow from being created in those portions of the body portion 13 that are positioned between circumferential grooves 15 that are mutually adjacent to each other in the direction of the bottle axis O. Thereby, it is possible to make it difficult for areas where stress is concentrated to occur in the body portion 13. Moreover, the movable wall portion 22 is provided such that it is able to pivot freely around the curved surface part 25 so as to cause the recessed circumferential wall portion 23 to move in the direction of the bottle axis O. Because of this, when an internal pressure variation arises inside the bottle, by causing the movable wall portion 22 to pivot, it is possible to absorb this internal pressure variation.

A first embodiment of the present invention has been described above with reference made to the drawings. However, the specific structure thereof is not limited to this first embodiment and various modifications and the like may be included therein insofar as they do not depart from the scope of the present invention.

(Second through Fourth Embodiments)

Figure 5:
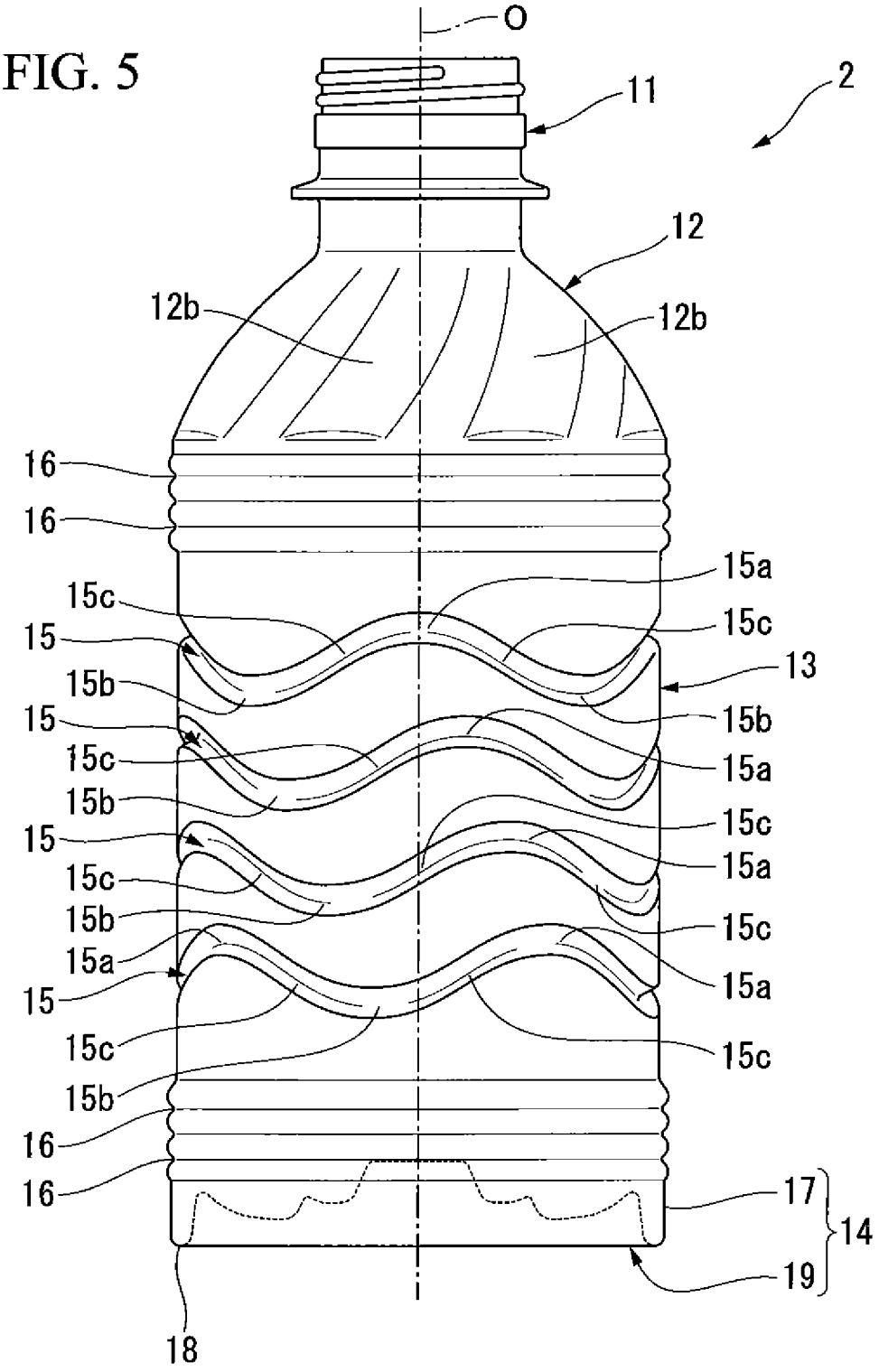
FIG. 5 is a side view of a bottle that is shown as a second embodiment of the present invention.
Figure 6:
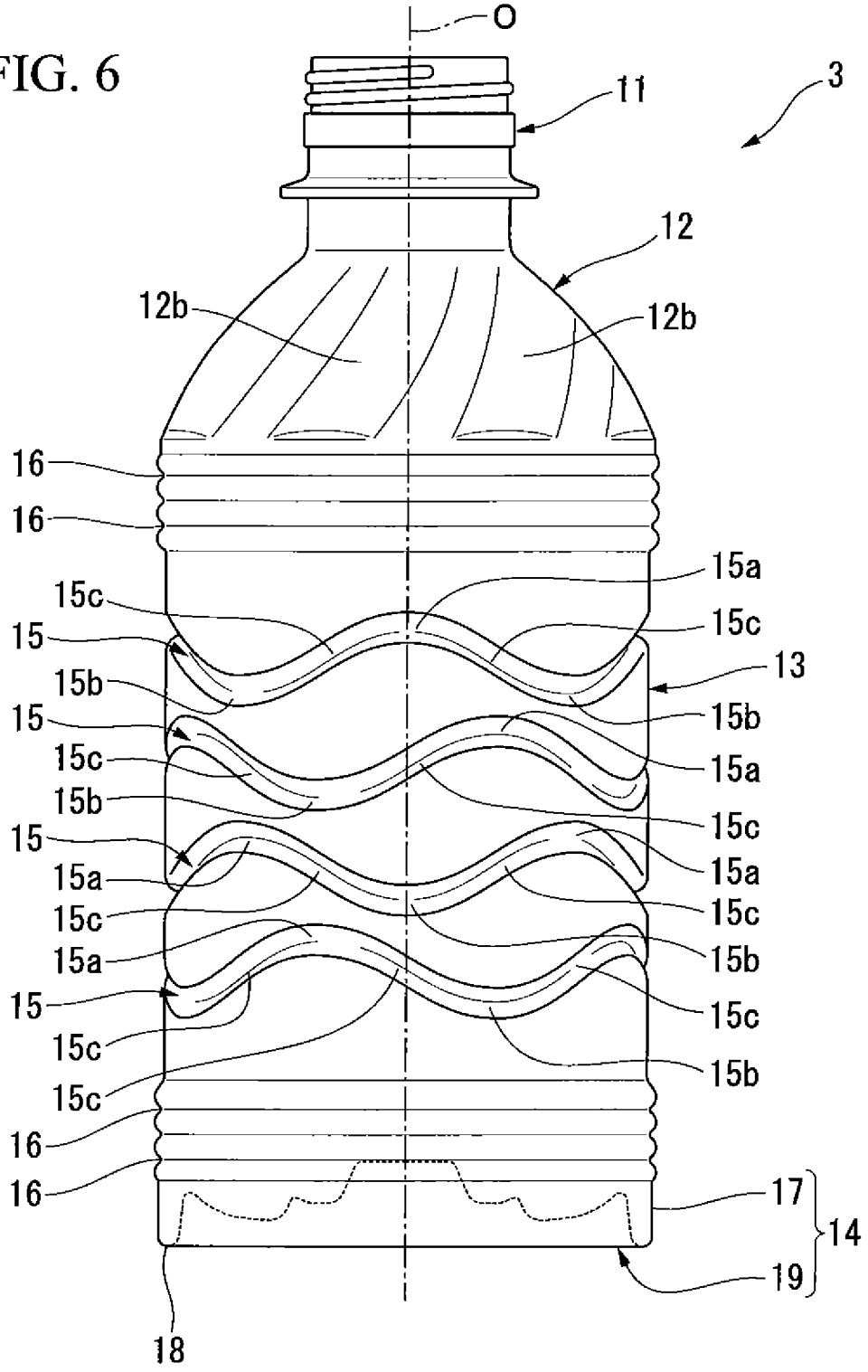
FIG. 6 is a side view of a bottle that is shown as a third embodiment of the present invention.
Figure 7:
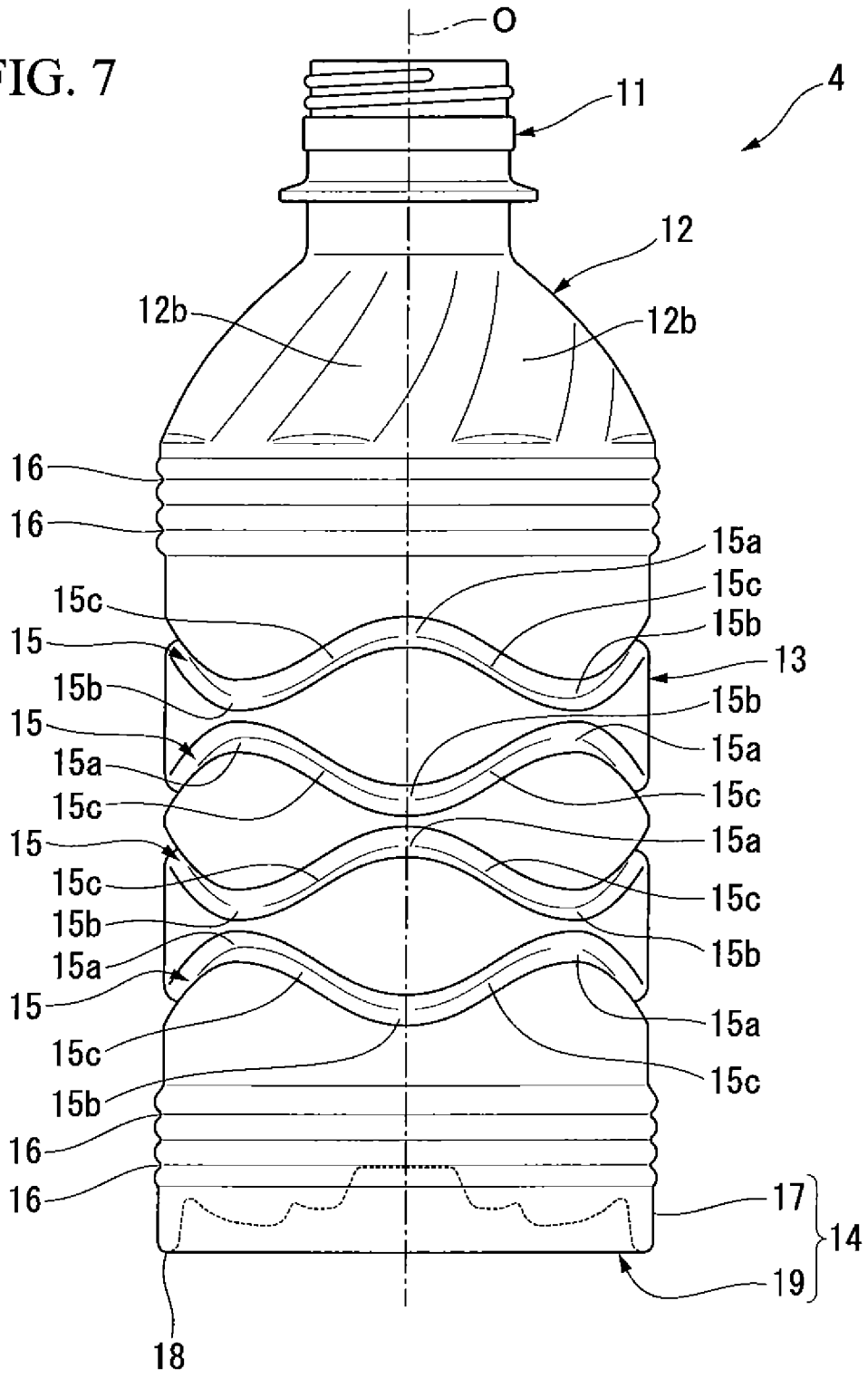
FIG. 7 is a side view of a bottle that is shown as a fourth embodiment of the present invention.

In the above-described first embodiment, for example, a plurality of vertical grooves 12*a* are formed in the shoulder portion 12. However, the present invention is not limited to this. For example, as second through fourth embodiments, as is shown in FIG. 5 through FIG. 7, it is also possible to form a plurality of panel surface portions 12*b* in the shoulder portion 12. A plurality of the panel surface portions 12*b* are positioned at a distance from each other in the circumferential direction, and they are recessed towards the inner side in the bottle radial direction, and they extend gradually from one side towards the other side in the circumferential direction as they move downwards. Moreover, the amount of offset in the circumferential direction between circumferential grooves 15 that are mutually adjacent to each other in the direction of the bottle axis O is not limited to that used in the above-described first embodiment, and may be altered to suit.

For example, as in a bottle 3 shown in FIG. 6 as a third embodiment, it is possible to employ a structure in which, of the circumferential grooves 15 that are mutually adjacent to each other in the direction of the bottle axis O, the positions in the circumferential direction where the tip portions 15*a* and 15*b* of one circumferential groove 15 are located and the position in the circumferential direction where the center of the intermediate portion 15*c* of another circumferential groove 15 is located may be set so as to coincide with each other. In the example shown in the drawing, the respective circumferential grooves 15 that are mutually adjacent to each other in the direction of the bottle axis O are arranged on the body portion 13 such that their positions are offset 22.5° from each other in the circumferential direction around the bottle axis O. Moreover, as in a bottle 4 shown in FIG. 7 as a fourth embodiment, it is possible to employ a structure in which, of the circumferential grooves 15 that are mutually adjacent to each other in the direction of the bottle axis O, the positions in the circumferential direction where the upper tip portion 15*a* of one circumferential groove 15 is located and the position in the circumferential direction where the lower tip portion 15*b* of another circumferential groove 15 is located may be set so as to coincide with each other. In the example shown in the drawing, the respective circumferential grooves 15 that are mutually adjacent to each other in the direction of the bottle axis O are arranged on the body portion 13 such that their positions are offset 45° from each other in the circumferential direction around the bottle axis O. Furthermore, it is also possible to employ a structure in which, of the circumferential grooves 15 that are mutually adjacent to each other in the direction of the bottle axis O, an area in the direction of the bottle axis O where one circumferential groove 15 is located partially overlaps with an area in the direction of the bottle axis O where the other circumferential groove 15 is located. In addition, the shape and the size of each one of the plurality of circumferential grooves 15 may be made different from the shape and size of the other circumferential grooves 15.

The bottom portion 14 is not limited to that used in the above-described embodiments, and may be altered to suit. For example, it is also possible for the movable wall portion 22, the recessed circumferential wall portion 23, and the annular concave portion 30 to not be provided, and it is further possible for the annular concave portion 30 to be formed intermittently at either short or long intervals around the entire circumference. It is also possible for a plurality of the annular concave portions 30 to be formed at a distance from each other in the bottle radial direction. The cross-sectional configuration of the annular concave portion 30 may be suitably altered, for example, to a circular configuration or a rectangular configuration or the like. Furthermore, the size of the annular concave portion 30 may also be altered to suit. The rising circumferential wall portion 21 may also be suitably altered, for example, by extending it in parallel with the direction of the bottle axis O, or by extending it diagonally to the bottle axis O, or the like. The movable wall portion 22 may also be suitably altered such as, for example, by making it protrude in parallel with the bottle radial direction.

The synthetic resin material used to form the bottle 1 may be suitably altered, for example, to a polyethylene terephthalate, polyethylene naphthalate, amorphous polyester or the like, or to a blend of these materials or the like. The bottle 1 is not limited to being a monolayer structural body, and may also be a laminated structural body having an intermediate layer. Examples of this intermediate layer include a layer formed from a resin material having gas barrier properties, a layer formed from recycled materials, and a layer formed from a resin material having oxygen absorption properties. In the above-described first through fourth embodiments, the surface configuration of a cross-section that is orthogonal to the bottle axis O of each of the shoulder portion 12, the body portion 13, and the bottom portion 14 is made circular. However, the present invention is not limited to this. This configuration may also be suitably altered, for example, to a polygonal configuration or the like. Moreover, in the above-described first through fourth embodiments, a case in which the outside curved wall 32 and the inside curved wall 35 are each positioned above the virtual line L is described. However, the present invention is not limited to this.

Note that, it is also possible for the component elements of the above-described first through fourth embodiments to be replaced with other known component elements, and for the above-described variant examples to be used in suitable combinations insofar as they do not depart from the scope of the present invention.

Next, a test to verify the above-described operational effects will be described.

Figure 8:
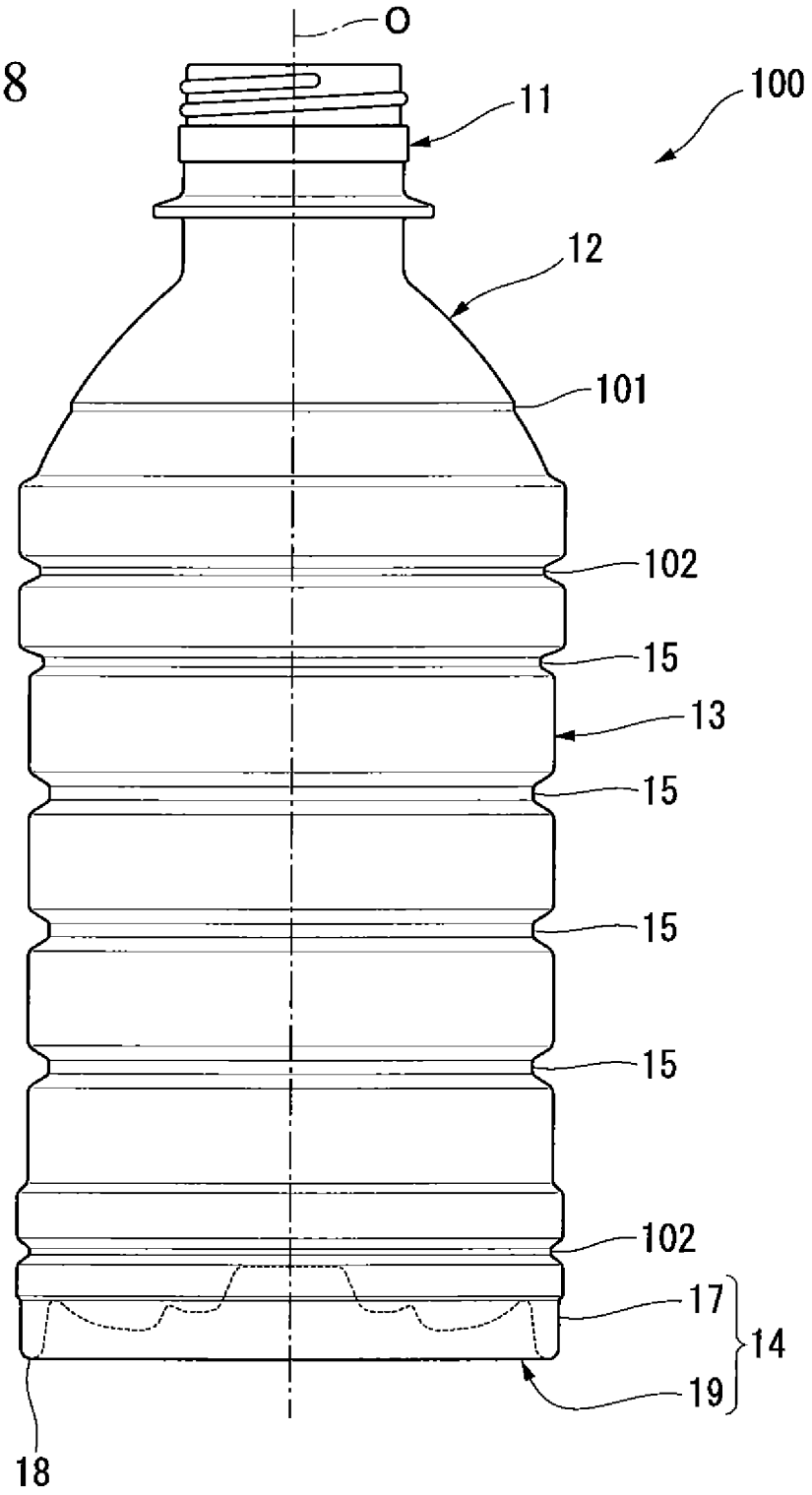
FIG. 8 is a side view of a bottle that is shown as a comparative example of the present invention.

The bottle 1 shown in FIG. 1 was employed for Example 1, while a bottle 2 shown in FIG. 5 was employed for Example 2, a bottle 3 shown in FIG. 6 was employed for Example 3, and a bottle 4 shown in FIG. 7 was employed for Example 4. In addition, a bottle 100 such as that shown in FIG. 8 in which the circumferential grooves 15 extend in a straight line continuously around the entire circumference was employed as a comparative example. Note that in the bottle 2 of Example 2, the respective circumferential grooves 15 that are mutually adjacent to each other in the direction of the bottle axis O are arranged on the body portion 13 such that, in the same way as in the bottle 1 of Example 1, their positions are offset 11.25° from each other in the circumferential direction around the bottle axis O. In the bottle 100 of the comparative example, instead of forming the vertical grooves 12*a* and the panel surface portions 12*b* in the shoulder portion 12, a step portion 101 is provided in a center portion in the direction of the bottle axis O of the shoulder portion 12 that extends around the entire circumference, and annular grooves 102 are formed respectively at both ends in the direction of the bottle axis O of the body portion 13. Each of the above-described bottles was then filled with contents, and in this state the buckling strength of each bottle was measured. As a result, it was found that the buckling strength of bottle 1 of Example 1 was 949.72 N, the buckling strength of bottle 2 of Example 2 was 1005.59 N, the buckling strength of bottle 3 of Example 3 was 1030.70 N, the buckling strength of bottle 4 of Example 4 was 1010.39 N, and the buckling strength of bottle 100 of the comparative example was 151.88 N. Namely, it was confirmed that the buckling strength was improved in bottles 1 through 4 of Examples 1 through 4 compared to the buckling strength of the bottle 100 of the comparative example.

INDUSTRIAL APPLICABILITY

According to the present invention, it is possible to provide a bottle in which it is possible to curb any decrease in the buckling strength of the bottle that arises as a result of circumferential grooves being formed.

DESCRIPTION OF THE REFERENCE NUMERALS

1~4 . . . Bottle
13 . . . Body portion
14 . . . Bottom portion
15 . . . Circumferential groove
15*a* . . . Upper tip portion
15*b* . . . Lower tip portion
18 . . . Grounding portion
19 . . . Bottom wall portion
21 . . . Rising circumferential wall portion
22 . . . Movable wall portion
23 . . . Recessed circumferential wall portion
25 . . . Curved surface part (i.e., connected portion with rising circumferential wall portion)

What is claimed is:

1. A bottle that is formed from a synthetic resin material in a cylindrical shape having a bottom at one end, comprising:

circumferential grooves that extend continuously around the entire circumference of a body portion and are formed at a distance from each other in a vertical direction, wherein the circumferential grooves extend cyclically in a circumferential direction while undulating up and down in a vertical direction when viewing the body portion from the side thereof, the bottle having a central axis extending in the vertical direction, wherein each of the circumferential grooves forms a wave pattern including an upper tip portion that is a tip portion of a hill portion, the upper tip portion forming an upwardly protruding curve, and a lower tip portion that is a tip portion of a valley portion, the lower tip portion forming a downwardly protruding curve, and an intermediate portion which connects the upper tip portion and the lower tip portion when viewing the body portion from the side thereof, wherein the circumferential grooves are formed such that, phases along the vertical direction of two wave patterns of any two of the circumferential grooves that are mutually adjacent to each other without any circumferential grooves located therebetween, are offset from each other, wherein the circumferential grooves are formed such that, the upper tip portion of one circumferential groove of the any two circumferential grooves that are mutually adjacent to each other in the vertical direction without any circumferential grooves located therebetween is located along a first axis of the body portion that is parallel with the central axis of the bottle and the lower tip portion of the same one circumferential groove is located along a second axis of the body portion that is parallel with the central axis of the bottle, the first axis and the second axis being spaced apart from each other in a circumferential direction of the bottle with the intermediate portion extending between the first axis and the second axis, and the upper tip portion or the lower tip portion of the other circumferential groove of the any two circumferential grooves that are mutually adjacent to each other in the vertical direction without any circumferential grooves located therebetween is located along a third axis of the body portion that is parallel with the central axis of the bottle, the third axis being located between the first axis and the second axis in the circumferential direction of the bottle such that the third axis intersects with the intermediate portion of the one circumferential groove, and wherein the circumferential grooves are formed such that one cycle is formed by a 90° angular range centered on the central axis of the bottle.

2. The bottle according to claim 1, wherein the circumferential grooves have the same shape and size as each other.

3. The bottle according to claim 2, wherein the bottle includes a bottom wall portion provided with:

a grounding portion that is positioned at an outer circumferential edge thereof;

a rising circumferential wall portion that continues on from an inner side in the bottle radial direction of the grounding portion and extends upwards;

an annular movable wall portion that protrudes from an upper end of the rising circumferential wall portion towards the inner side in the bottle radial direction; and a recessed circumferential wall portion that extends upwards from an inner end in the bottle radial direction of the movable wall portion, wherein the movable wall portion is provided such that it is able to pivot freely around a connected portion with the rising circumferential wall portion so as to cause the recessed circumferential wall portion to move in a vertical direction.

4. The bottle according to claim 1, wherein the bottle includes a bottom wall portion provided with:

a grounding portion that is positioned at an outer circumferential edge thereof;

a rising circumferential wall portion that continues on from an inner side in the bottle radial direction of the grounding portion and extends upwards;

an annular movable wall portion that protrudes from an upper end of the rising circumferential wall portion towards the inner side in the bottle radial direction; and a recessed circumferential wall portion that extends upwards from an inner end in the bottle radial direction of the movable wall portion, wherein the movable wall portion is provided such that it is able to pivot freely around a connected portion with the rising circumferential wall portion so as to cause the recessed circumferential wall portion to move in a vertical direction.

5. The bottle according to claim 1, wherein the one and other circumferential grooves of any two of the circumferential grooves mutually adjacent to each other without any circumferential grooves located therebetween, are offset 11.25° from each other in the circumferential direction around the central axis of the bottle.

6. The bottle according to claim 1, wherein the one and other circumferential grooves of any two of the circumferential grooves mutually adjacent to each other without any circumferential grooves located therebetween, are offset 22.5° from each other in the circumferential direction around the central axis of the bottle.

* * * * *